US006449441B2

(12) United States Patent
Masuda

(10) Patent No.: US 6,449,441 B2
(45) Date of Patent: Sep. 10, 2002

(54) DEVELOPER SUPPLYING APPARATUS

(75) Inventor: Koji Masuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/873,998

(22) Filed: Jun. 6, 2001

(30) Foreign Application Priority Data

Jun. 8, 2000 (JP) ..... 2000-172255

(51) Int. Cl.[7] ..... G03G 15/08
(52) U.S. Cl. ..... 399/58; 399/61
(58) Field of Search ..... 399/58, 60, 61, 399/62, 63, 64, 30, 258, 260, 49

(56) References Cited

U.S. PATENT DOCUMENTS 5,095,338 A * 3/1992 Hayes, Jr. et al. ..... 399/61 X
5,430,530 A * 7/1995 Ott et al. ..... 399/58 X
5,619,312 A * 4/1997 Hatano et al. ..... 399/61
6,115,561 A * 9/2000 Fukushima ..... 399/49

FOREIGN PATENT DOCUMENTS

JP 2-21591 B2 5/1990
JP 8-339142 A 12/1996

* cited by examiner

*Primary Examiner*—Sophia S. Chen
(74) *Attorney, Agent, or Firm*—Fitzpatrick, Cella, Harper & Scinto

(57) ABSTRACT

A developer supplying apparatus includes a developer container containing therein a developer provided with a toner and a carrier, a developer bearing member for magnetically bearing and carrying the developer in the developer container to develop an electrostatic latent image formed on an image bearing member, a detector for detecting information corresponding to the density of the toner, and a supplying device for supplying the toner and the carrier to the developer container in conformity with the output of the detector. The intensity of an electric field for shifting the carrier from the developer bearing member to the image bearing member is greater than the intensity of an electric field formed between a nonimage portion of the electrostatic latent image formed on the image bearing member and the developer bearing member.

11 Claims, 7 Drawing Sheets

DEVELOPER SUPPLYING APPARATUS

BACKGROUND OF THE INVENTION

1. Field of the Invention

This invention relates to a developer supplying apparatus in an image forming apparatus using the electrostatic recording process or the electrophotographic process, and particularly to a developer supplying apparatus in an image forming apparatus such as a copier, a printer or a facsimile apparatus.

2. Related Background Art

In image forming apparatuses using the electrophotographic process according to the conventional art, and above all, image forming apparatuses for effecting chromatic color image formation, two-component development using a mixture of a nonmagnetic toner and a magnetic carrier as a developer is widely utilized.

The two-component development, as compared with the presently known other developing methods, has such merits as the stability of the quality of image and the durability of the apparatus while on the other hand, the deterioration of the developer due to long-period endurance, particularly the deterioration of the carrier, has been unavoidable and therefore, with the long-period use of the image forming apparatus, it is necessary to perform the work of interchanging the developer.

Several techniques for solving this problem are known. For example, a technique disclosed in Japanese Patent Publication (Koukoku) No. 2-21591 will hereinafter be described briefly.

That is, in a developing device for an electrophotographic copier, provision is made of agitating means for agitating a carrier and a toner, and a developing roll for supplying the developer agitated by the agitating means to a photosensitive member, and a carrier supplying device and a toner supplying device separate from or integral with each other are provided above the agitating means, and further a developer spillover portion is provided on the side wall of the housing of the developing device.

By thus providing the developer spillover portion, it is possible to supply a fresh developer little by little by the supplying apparatus and also discharge the developer from the developer spillover portion and therefore, the characteristic of the developer in the housing of the developing device can be maintained constant and as the result, the quality of copy images can also be maintained constant.

Also, according to such a technique, the old developer in the housing of the developing device is sequentially automatically discharged from the developer spillover portion and therefore, the cumbersome developer interchanging work, as in an apparatus not provided with the developer spillover portion, including detaching the developing device from the copier, taking out the old developer in the housing of the device, refilling the housing with a fresh developer, and thereafter mounting the developing device again becomes unnecessary and moreover, the scattering of the developer is prevented, and this is hygienic.

The deteriorated developer (carrier) is gradually replaced with fresh developer, whereby the apparent progress of deterioration of the carrier is stopped and as the whole of the developer, the characteristic (developing characteristic) is stabilized. Thereby, the cumbersome work of the interchange of the developer is made unnecessary and improvements in a maintenance property and usability can be achieved.

However, in the case of the image forming apparatus according to the conventional art as described above, the following problem has arisen.

In recent years, the market of full color copiers/printers has enlarged and various functions have been required, and in such situations, it has become a proposition to supply the market with image forming apparatuses capable of forming, for example, images of high quality stably for a long period.

In the above-described apparatus, however, the carrier which has just been supplied and is not yet deteriorated is also discharged with the old developer and therefore, with a long-period use, there is brought about a state in which the remarkably deteriorated carrier and the slightly deteriorated carrier are mixed with each other and thus, the apparent progress of deterioration of the carrier is stopped and as the whole of the developer, the characteristic is stabilized, but the level of stabilization becomes a level considerably aggravated as compared with that during the initial installation.

That is, in the image forming apparatus according to the conventional art, the cumbersome work for the interchange of the developer becomes unnecessary and maintenance property and usability are improved, but the stability of the characteristic of the developer has been one at a low level, and it has been impossible to form images of high quality for a long period.

SUMMARY OF THE INVENTION

It is an object of the present invention to provide an image forming apparatus in which an improvement in a maintenance property concerned with the interchange of a developer can be achieved and also, a deteriorated carrier can be selectively shifted from a developer bearing member to an image bearing member.

Further objects of the present invention will become apparent from the following detailed description when read in conjunction with the accompanying drawings.

DESCRIPTION OF THE PREFERRED EMBODIMENTS

Some preferred embodiments of the present invention will hereinafter be described in detail with reference to the drawings. However, the dimensions, materials, shapes and relative arrangement of constituent parts described in these embodiments are not restrictive unless specifically described.

<First Embodiment>

A developing device and an image forming apparatus according to a first embodiment of the present invention will hereinafter be described with reference to FIGS. 1 to 5.

Figure 2:
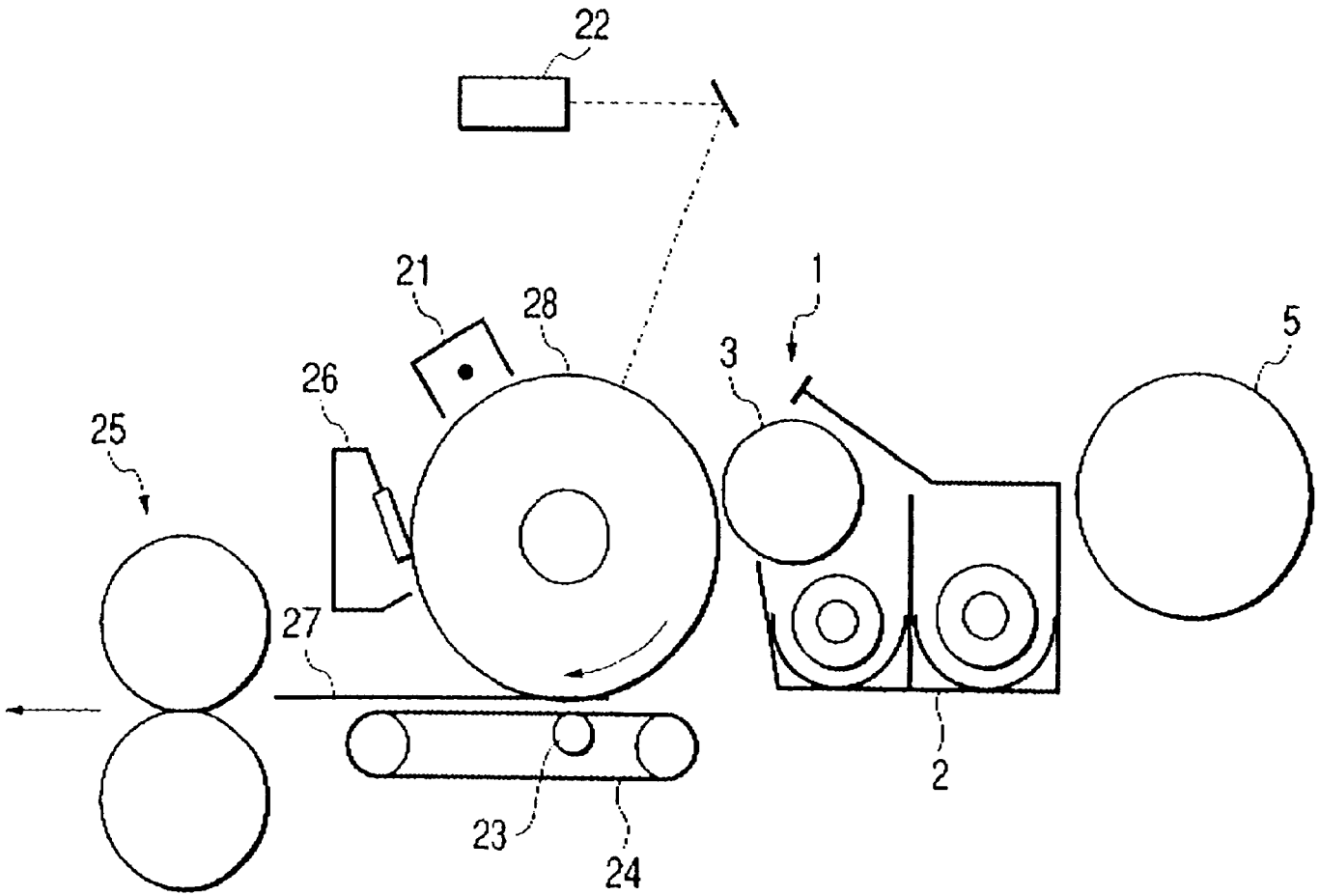
FIG. 2 is a typical cross-sectional view of an image forming apparatus according to a first embodiment of the present invention.

Reference is first particularly had to FIG. 2 to describe the general construction of the image forming apparatus according to the first embodiment of the present invention. FIG. 2 is a typical cross-sectional view of the image forming apparatus according to the first embodiment of the present invention.

In FIG. 2, the surface of a photosensitive drum 28 as an image bearing member uniformly charged (in the present embodiment, to the negative polarity) by a charger 21 as charging means is first exposed to light by a laser exposure device 22 as latent image forming means to thereby form an electrostatic latent image conforming to the image information of an original on the photosensitive drum 28, and this latent image is developed by the developing device 1 by the use of a developer (a non-magnetic toner of the negatively chargeable characteristic and a magnetic carrier) to thereby form a toner image on the photosensitive drum 28.

The toner image is transferred onto a recording sheet 27 as a recording medium conveyed by a transfer belt 24, by a transfer electric field by a transfer charger 23, whereafter the recording sheet 27 is separated from the transfer belt 24, and is pressurized and heated by a fixing device 25 to thereby obtain a permanent image.

Also, any toner and carrier remaining on the photosensitive drum 28 after the transfer are removed by a cleaner (cleaning device) 26, and the photosensitive drum becomes ready for the next image formation. The cleaner 26 has a blade contacting with the photosensitive drum 28 over an image formable area and a nonimage formable area (FIGS. 4 and 6) thereon, and as will be described later, is designed to frictionally remove even a deteriorated carrier electrostatically shifted from a developing sleeve to the nonimage formable area on the photosensitive drum 28 against a magnetic force.

Figure 1:
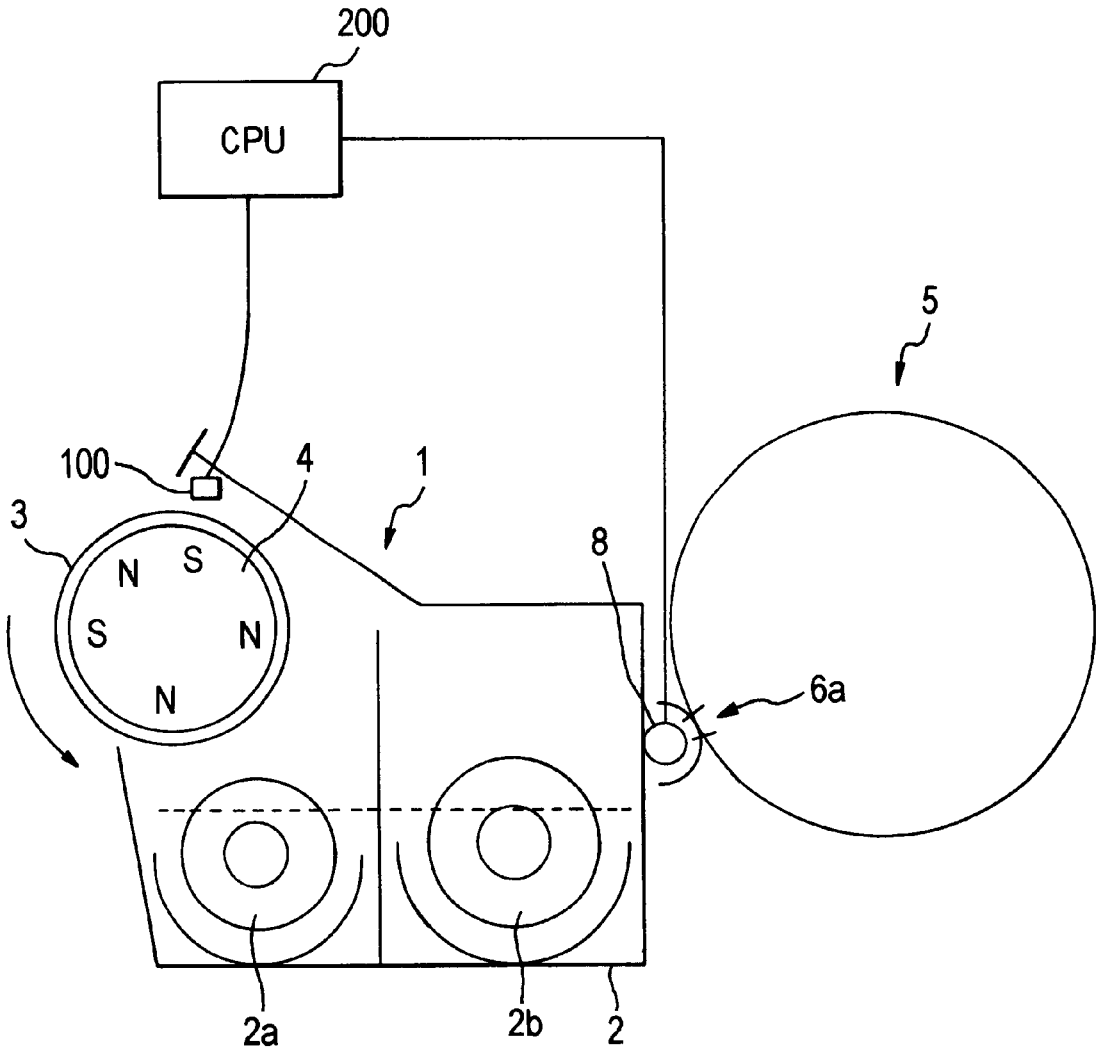
FIG. 1 is a typical cross-sectional view of a developing device according to an embodiment of the present invention.

The developing device 1 will now be described in detail with reference particularly to FIG. 1. FIG. 1 is a typical cross-sectional view of the developing device according to the embodiment of the present invention.

A two-component developer comprising a non-magnetic toner and a magnetic carrier is contained in the main body of the developing device 1, and the mixing ratio thereof is about 1:9 by weight ratio. This ratio should be properly adjusted by the charged amount of the toner, the particle diameter of the carrier, the construction of the image forming apparatus, etc., and need not always follow this value.

The developing device 1 has an opening portion providing a developing area at a position opposed to the photosensitive drum 28, and the developing sleeve 3 as a developer bearing member is rotatably disposed in this opening portion in such a manner as to be partly exposed.

This developing sleeve 3 is formed of a nonmagnetic material, and contains therein a stationary magnet 4 which is magnetic field generating means. During the developing operation, the developing sleeve 3 is rotated in the direction indicated by the arrow in FIG. 1, and bears and carries the two-component developer in a developer container 2 to the developing area opposed to the photosensitive drum 28 while holding two-component developer in a layer shape, and develops the electrostatic latent image formed on the photosensitive drum 28. At this time, as will be described later, a vibration voltage comprising a DC voltage and an AC voltage superimposed upon each other, i.e., a developing bias, is applied to the developing sleeve 3. The applied bias to the developer sleeve in FIGS. 4 and 6 which will be described later means the above-mentioned DC voltage.

The developer after having developed the electrostatic latent image is carried in accordance with the rotation of the developing sleeve 3 and is collected into the developer container 2. In the developer container 2, the developer therein is circulated and mixed and agitated by a first developer circulating screw 2*a* (near to the developing sleeve 3) and a second developer circulating screw 2*b* (far from the developing sleeve 3).

In the example shown in FIG. 1, the circulating direction of the developer is the direction from the front side to the back side of the drawing plane on the first developer circulating screw 2*a* side, and is the direction from the back side to the front side of the drawing plane on the second developer circulating screw 2*b* side.

Figure 3:
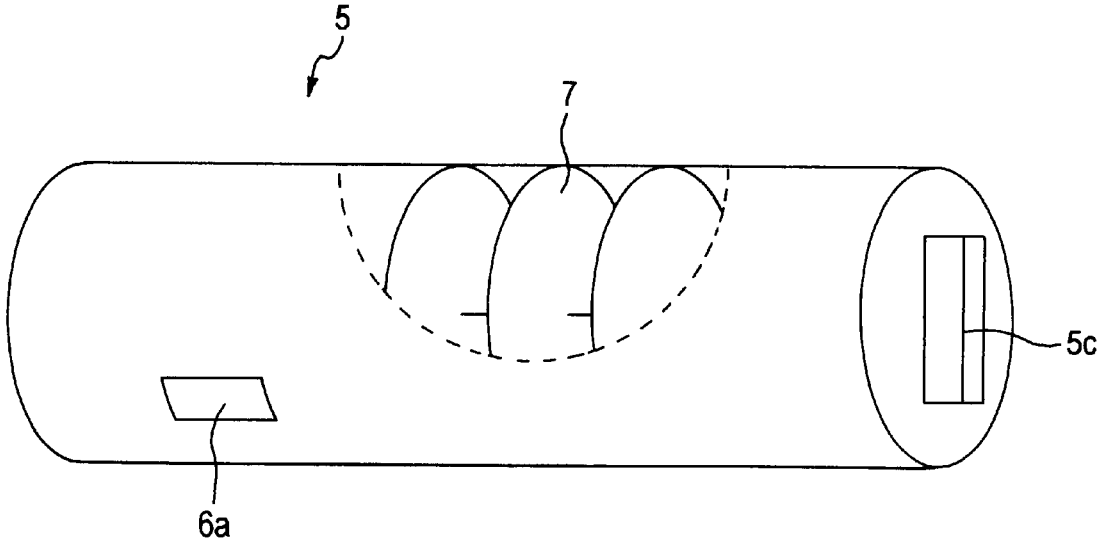
FIG. 3 is a typical partly broken-away perspective view of a developer cartridge.

A developer cartridge 5 as supplying means for supplying a fresh developer is substantially cylindrical and is easily detachably mountable with respect to the main body of the image forming apparatus (the main body of the developing device). FIG. 3 is a typical partly broken-away perspective view of the developer cartridge 5 detached from the main body of the apparatus.

The developer cartridge 5 is inserted from the front side with respect to the main body of the image forming apparatus, and is rotated by the grip 5*c* on the front side being twisted to the right side, and by this rotating operation, a developer supplying port 6*a* is opened. When the developer cartridge 5 is to be detached from the main body of the image forming apparatus, the grip 5*c* is twisted to the left side, whereby the opening portion is closed, and the powder contained in the cartridge does not leak outwardly.

Also, an agitating member 7 for agitating the developer to be supplied is contained in the developer cartridge 5. Although the interior of the developer cartridge 5 is partly shown in FIG. 3, the agitating member 7 is provided by resin film formed into a spiral shape as shown and adapted to be rotatively driven by a shaft of a rigid material and therefore, is suitably rotated to thereby agitate the developer in the cartridge 5, and has the function of assisting in the supply of the developer.

The amount of toner consumed by the image forming step (the developing step) passes from the developer cartridge 5 and through the developer supplying port 6*a* by the rotational force of the agitating member 7 and gravity, and is carried to a supplying screw 8 disposed in the developer container 2, and is supplied into the developer container 2 in accordance with the rotation of the supplying screw 8.

In this manner, the developer to be supplied (fresh developer) is supplied from the developer cartridge 5 into the main body of the developing device 1. The mixing ratio of the toner and carrier of this developer to be supplied is about 9:1 by weight ratio, but is not particularly limited to this value. That is, it can also be considered that the amount of toner is overwhelmingly great relative to the ratio of the two-component developer in the developer container 2 and taking the volume ratio into consideration, a slight amount of carrier is mixed with the toner.

That is, when making up for the toner consumed by image formation, a slight amount of carrier is also gradually supplied. If the ratio of the carrier in the supplied developer becomes great, the amount of replacement of carrier will become great for the supply of the same amount of toner and the two-component developer in the developing device 1 will approximate to a fresh state, but correspondingly the amount of carrier consumed will become great. Therefore, it is referable to discretely determine suitable mixing ratios in respective apparatuses.

As methods of controlling the amount of toner supply, there are known various methods such as a method of optically or magnetically detecting the toner density of a two-component developer (the ratio of the weight of toner to the weight of the whole developer) and a method of developing a reference latent image on the photosensitive drum 28 and detecting the density of the toner image and therefore, it is possible to suitably select one of those methods.

In the present embodiment, the optical detection of the density of the toner in the developer container 2 is effected by an optical sensor 100 provided with a light emitting portion and a light receiving portion, and in conformity with the output of this sensor 100, a CPU 200 determines the amount of toner supply, and a signal conforming thereto is fed back to a motor for rotating the screw 8.

A description will now be made of the two-component developer, i.e., the toner and carrier, used in the present embodiment.

The toner has coloring resin particles containing binder resin, a coloring agent, and as required, other additive, and coloring particles having an extraneous additive such as colloidal silica fine powder extraneously added thereto. It is preferable that the toner be negatively chargeable polyester resin and the volume average particle diameter thereof be equal to or greater than 5 $\mu$m and equal to or less than 8 $\mu$m. In the present embodiment, the volume average particle diameter is 7.0 $\mu$m.

As the carrier, metals such as surface oxidized or unoxidized iron, nickel, cobalt, manganese, chromium and rare earth, and alloys thereof or oxide ferrite or the like are suitably usable, and methods of manufacturing these magnetic particles are not particularly limited. The weight average particle diameter of the carrier is 20 to 50 $\mu$m, and preferably 30 to 40 $\mu$m, and the resistivity thereof is $10^7$ Ωcm or greater, and preferably $10^8$ Ωcm or greater. In the present embodiment, use is made of a carrier having the resistivity of $10^8$ Ωcm or greater.

The volume average particle diameter of the toner used in the present embodiment was measured by apparatuses and a method shown below.

As the measuring apparatuses, use was made of Coulter Counter TA-II type (produced by Coulter K. K.), an interface for outputting a number average distribution and a volume average distribution (produced by Nikkaki K. K.) and CX-I personal computer (produced by Canon Inc.), and as electrolytic water solution, use was made of 1% NaCl water solution prepared by the use of first class sodium chloride.

The measuring method is as shown below. That is, 0.1 ml of interfacial active agent or preferably alkyl benzene sulfonate as a dispersing agent is added to 100 to 150 ml of the above-mentioned electrolytic water solution, and 0.5 to 50 mg of measurement sample is added.

The electrolytic water solution with the sample suspended therein is subjected to the dispersing process by an ultrasonic dispersing device for about 1 to 3 minutes, and the size distribution of particles of 2 to 40 $\mu$m is measured by the above-mentioned Coulter Counter TA-II type by the use of an aperture of 100 $\mu$m as an aperture to thereby find the volume average distribution. From the thus found volume average distribution, the volume average particle diameter is obtained.

Also, the resistivity of the carrier used in the present embodiment was measured by a method of obtaining the resistivity of the carrier from an electric current flowing to a circuit with an applied voltage E (V/cm) between two electrodes applied to one electrode under the pressure of 1 kg of weight by the use of a sandwich type cell having a measuring electrode area of 4 $cm^2$ and an inter-electrode interval of 0.4 cm.

A construction for effecting the collection of the developer from the developer container 2 which is the characteristic portion of the present embodiment (eliminating means for eliminating the developer), etc. will now be described in detail with reference particularly to FIGS. 4 and 5.

Figure 4:
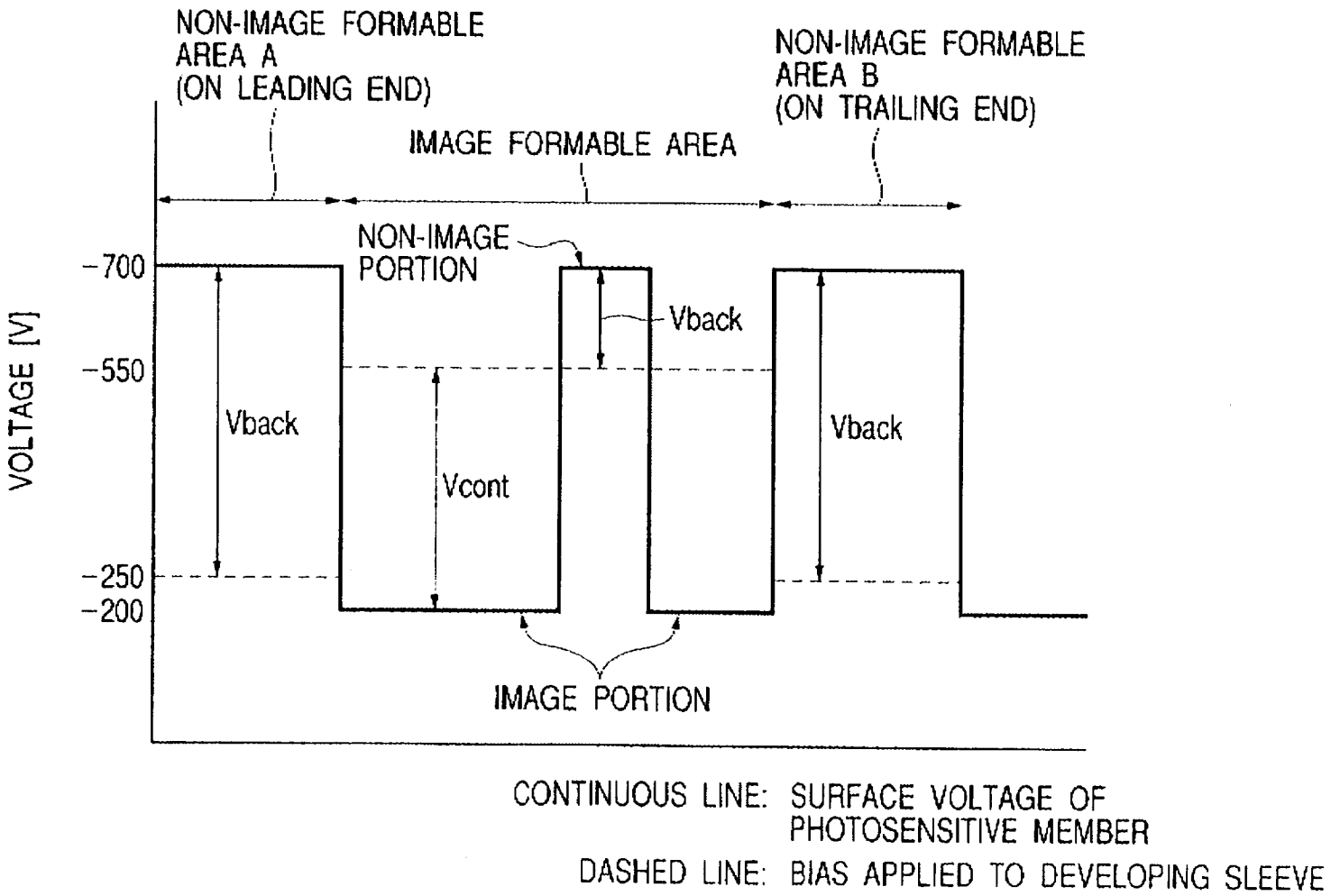
FIG. 4 is a voltage relation graph showing the voltage relations among various portions in the image forming apparatus according to the first embodiment of the present invention.
Figure 5:
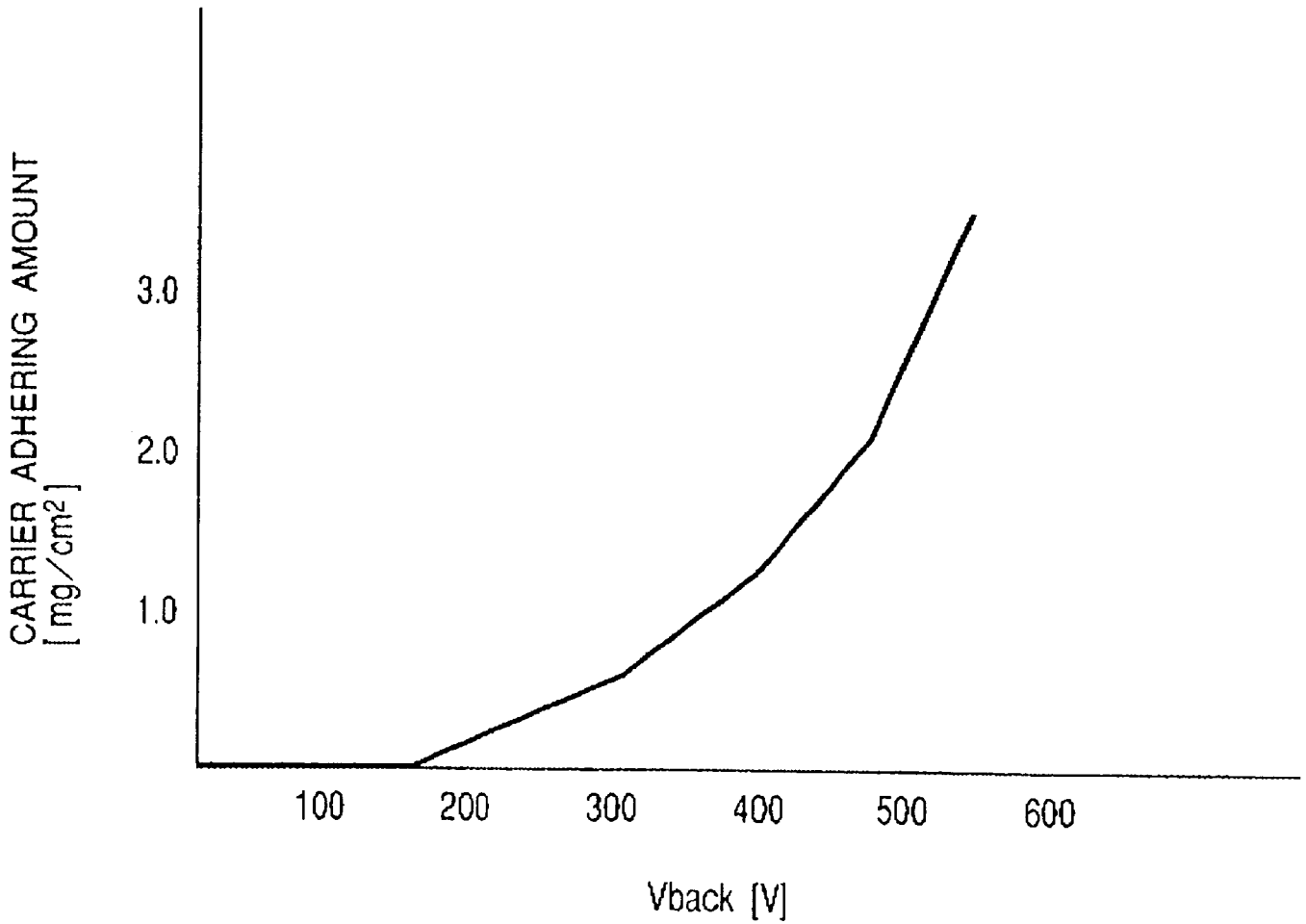
FIG. 5 is a relation graph showing the relation of the adhering amount of carrier onto the surface of an image bearing member (the surface of a drum) to a fog removal voltage.

FIG. 4 is a voltage relation graph showing the voltage relations among various portions in the image forming apparatus according to the first embodiment of the present invention, and FIG. 5 is a relation graph showing the relation of the adhering amount of carrier onto the surface of the image bearing member (the surface of the drum) to a fog removal voltage (the difference between the voltage of the non-image portion (dark portion) of the electrostatic latent image on the image formable area and the developing bias applied to the developing sleeve) Vback.

FIG. 4 shows the voltage on the surface of the drum in the direction of rotation of the drum after the surface of the photosensitive drum 28 charged by the charger 21 has been exposed by the laser 22 and the developing bias voltage applied to the developing device.

As shown in FIG. 4, during development and during carrier collection, the surface of the photosensitive drum 28 is uniformly charged to −700 V by the charger 21, and the image portion (toner adhering portion) of the image formable area (which means a portion corresponding to an electrostatic latent image formable area, and corresponding to an area in which an image can be finally formed on a recording sheet) is exposed by the laser and assumes −200 V. The nonimage portion of the image formable area remains maintained at −700 V.

The developing bias when the image portion is developed is −550 V, and the toner adheres to develop the image portion on the photosensitive drum by developing contrast (Vcont)=350 V given by the difference between the voltage of the exposed portion by the laser and the developing bias voltage.

On the other hand, the voltage of the nonimage portion (the so-called white ground potion) is −700 V and therefore, the fog toner (the toner charged to the normal charging polarity, in the present embodiment, the negative polarity) is pulled back from on the drum to the developing sleeve 3 side by the fog removal voltage (Vback)=150 V given by the difference between the developing bias voltage and the white ground portion voltage.

As described above, during ordinary image formation (during development), the fog removal voltage is as small as 150 V and therefore, an electrical force attracting the carrier to the photosensitive drum which acts on the carrier for triboelectrically charging the toner to the negative polarity is weaker than the force attracting the carrier to the developing sleeve 3 side by the magnetic force of the magnet in the developing sleeve 3 and thus, the carrier does not adhere to the drum.

The description hitherto is a description regarding the ordinary operation in the portion corresponding to the ordinary image formable area. A description will now be made of an operation for selectively discharging the deteriorated carrier from the developing sleeve side (the developer container 2) to the photosensitive drum side by the utilization of the fog removal voltage.

In the present embodiment, in the nonimage formable areas (which mean portions corresponding to areas in which an image cannot be finally formed on a recording sheet, and for example, when printing is effected on the recording sheet, the portion between characters which is not printed is neither included in the nonimage formable portion) A and B upstream and downstream of the image formable area with respect to the direction of rotation of the photosensitive drum (the leading end side and trailing end side of the image formable area), the photosensitive drum is charged to −700 V as in the image formable area, but the bias applied to the developing sleeve is changed over to −250 V by the CPU 200, whereby the fog removal voltage (Vback) is rendered into 450 V, that is, made greater than the fog removal voltage during development.

As can be seen from FIG. 5, when the fog removal voltage (Vback) is rendered into 450 V, the carrier adheres (shifts) onto the photosensitive drum. The adhering carrier is carried on the photosensitive drum 28 and is collected by the cleaning device (cleaner 26).

Of course, the values of the voltage on the photosensitive drum, the developing bias, Vcont, Vback, and so on used in the description hitherto are not limited to these values, but are suitably variable by the differences of the developer and apparatus construction.

As described above, design is made such that by the utilization of the fog removable voltage, the developer is eliminated by the electrical force, whereby of the carrier eliminated, particularly the deteriorated carrier is preferentially and selectively eliminated and therefore, by fresh carrier being supplied to the developing device, the characteristic of the developer can be maintained in a state approximate to that during the initial installation for a long period.

This point will further be described hereinafter.

The deterioration of the developer by the long-period used thereof appears as the phenomenon that the charged amount of the carrier is increased chiefly by two causes, i.e., the so-called toner spent in which the toner adheres to the surface of the carrier, and the so-called extraneous additive adherence in which the extraneous additive for the control of charging separated from the toner adheres to the surface of the carrier. The magnetization of the carrier does not change so much between the initial time and the long-period endurance.

Here, the volume resistivity of the toner is high as compared with that of the carrier and therefore, as the toner spent progresses, the resistivity of the carrier becomes higher. The carrier contacts with the toner and is triboelectrically charged, whereby it is charged to the opposite polarity to the toner, but gradually decays by being discharged to the developing sleeve and into the air.

However, when the toner is spent and the resistivity becomes higher, it becomes difficult for the carrier to decay and therefore, the triboelectricity becomes high as compared with that of the carrier during the initial installation. Accordingly, the deteriorated carrier high in triboelectricity becomes more liable to be attracted to the photosensitive drum side by an electrical force than the carrier during the initial installation or the carrier to be supplied.

That is, in the construction as described above, the deteriorated carrier overcomes the magnetic binding force of the magnet and becomes liable to be shifted by the intensity of the electric field by the fog removal voltage (as described above, the voltage (Vback) at which the force acts from the photosensitive drum to the developing sleeve side).

Also, if the adhering amount of the extraneous additive to great, the carrier becomes easy to separate from the toner by the spacer effect and again in this case, as the carrier becomes more deteriorated, it becomes more liable to be attracted by the electrical force.

Accordingly, the more deteriorated becomes the carrier, the more liable to be attracted preferentially to the photosensitive drum side it becomes with the electric force exceeding, and after all, it becomes possible to eliminate the deteriorated carrier more preferentially than the carrier not deteriorated.

As described above, it is possible to achieve the improvement in maintenance property that the cumbersomeness of the developer interchanging work is unnecessary by a simple construction, and yet stably form images of high quality equal to that during the initial installation for a long period.

<Second Embodiment>

Figure 6:
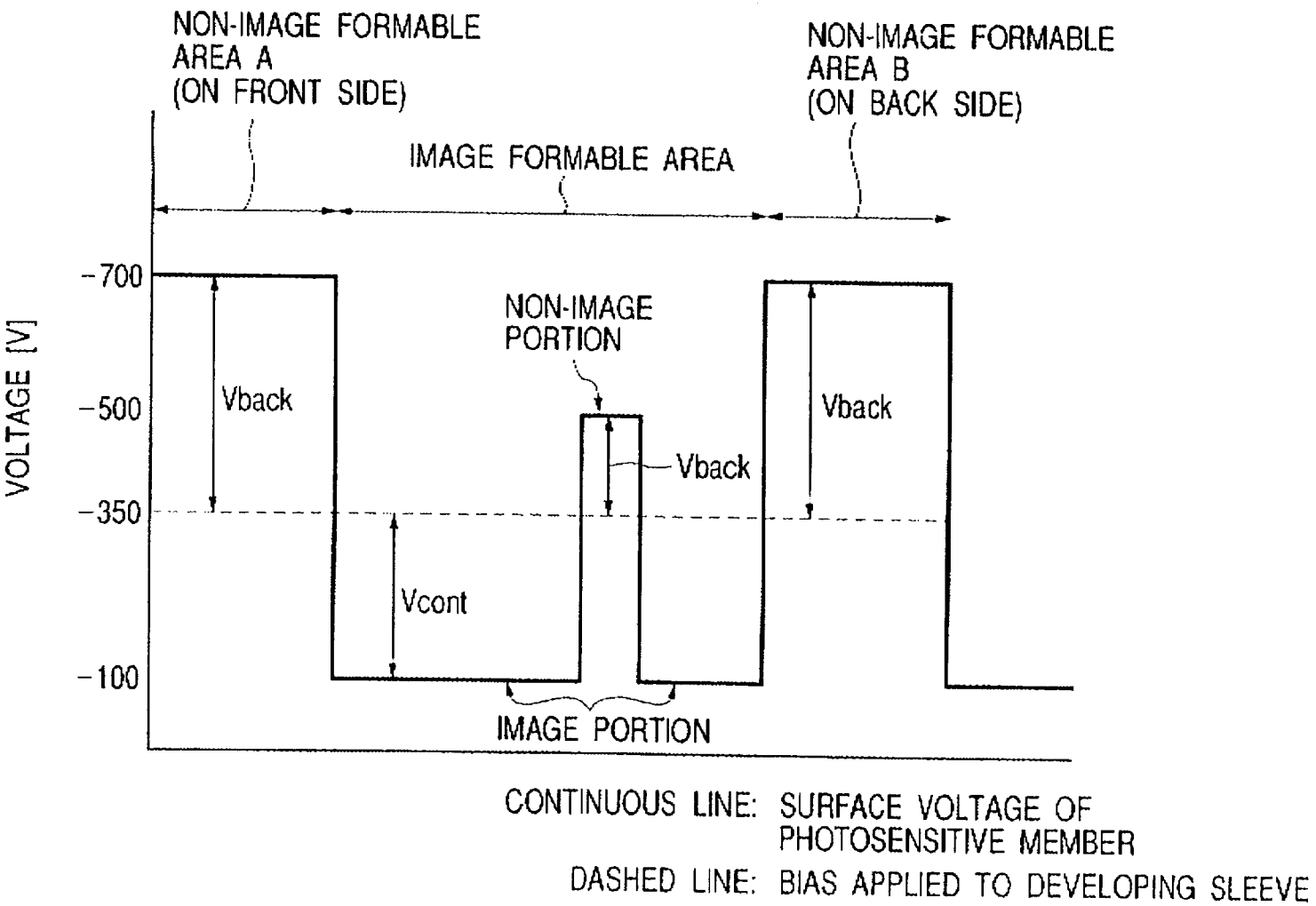
FIG. 6 is a voltage relation graph showing the voltage relations among various portions in an image forming apparatus according to a second embodiment of the present invention.

FIG. 6 shows a second embodiment. While in the first embodiment, there has been shown a case where the area for eliminate the deteriorated developer is upstream and downstream of the image formable area with respect to the direction of rotation of the photosensitive drum, there is shown in the present embodiment a case where the area for eliminating the deteriorated developer is the opposite end sides of the image formable area in the widthwise direction (the lengthwise direction of the photosensitive drum).

In the other points, the construction and action of the present embodiment are the same as those of the first embodiment and therefore, the same constituent portions are given the same reference characters and need not be described.

FIG. 6 is a voltage relation graph showing the voltage relations among various portions in the image forming apparatus according to the second embodiment of the present invention, and as in the case of the above-described first embodiment, it shows the voltage on the drum in the direction of rotation of the drum after charged and exposed and the developing bias voltage applied to the developing device.

The voltage on the surface of the photosensitive drum 28 in the present embodiment is −500 V in the image portion, and −700 V in the nonimage portion. As a method of changing the voltages of the image portion and the nonimage portion, there is a method of changing the wire height or the grid shape of the charger, but this is not restrictive.

The image portion of the image formable area is exposed by the laser and assumes −100 V. The developing bias when the image portion is developed is −350 V, and the toner adheres to develop the image portion on the photosensitive drum by the developing contrast (Vcont)=250 V.

On the other hand, the voltage of the nonimage portion (the so-called white ground portion) of the image formable area (the electrostatic latent image formable area) is −500 V and therefore, by the fog removal voltage (Vback=150 V, the fog toner (the toner charged to the regular charging polarity) is pulled back from on the photo sensitive drum to the developing sleeve 3 side.

As described above, the fog removal voltage during ordinary image formation (during development) is as small as 150 V and therefore, the electrical force acting on the carrier which attracts the carrier to the photosensitive drum side is weaker than the force which restrains the carrier on the developing sleeve 3 side by the magnetic force of the magnet in the developing sleeve 3 and therefore, the carrier does not adhere to the drum.

The description hitherto is a description regarding the ordinary operation in the portion corresponding to the ordinary image formable area. A description will now be made of an operation for eliminating the deteriorated carrier by the utilization of the fog removal voltage.

In the present embodiment, in the nonimage formable areas A and B on the opposite end sides (the front side and the back side) in the widthwise direction with respect to the image formable area, unlike the nonimage portion of the image formable area, the surface of the photosensitive drum is charged to −700 V, and the bias applied tot he developing sleeve is the same voltage −350 V as that of the image portion of the image formable area, whereby the fog removal voltage (Vback) is rendered into 350 V and therefore, the deteriorated carrier can be preferentially and selectively shifted to the above-mentioned areas A and B on the photosensitive drum 28.

Further, the present embodiment is of a construction in which the deteriorated carrier is shifted to the nonimage formable areas A and B in which no image is formed and therefore, even if the surface of the photosensitive drum is injured by the rub between the carrier shifted onto the photosensitive drum and the blade of the cleaner, design can he made so that ordinary image formation is affected in no way.

In the other points, the construction, etc. of the present embodiment are similar to those of the above-described first embodiment.

Accordingly, like the above-described first embodiment, the present embodiment has a high maintenance property and can maintain a high quality of image.

Further, in the present embodiment, the deteriorated carrier is made to adhere to the nonimage portion of the photosensitive drum in the lengthwise direction thereof, whereby always the discharging operation for the deteriorated carrier is effected in the nonimage portion and therefore, when the deteriorated carrier is to be collected by the cleaning device, that portion of the drum which can become an image area can be prevented from being injured, and the quality of image can be prevented from being aggravated.

<Third Embodiment>

Figure 7:
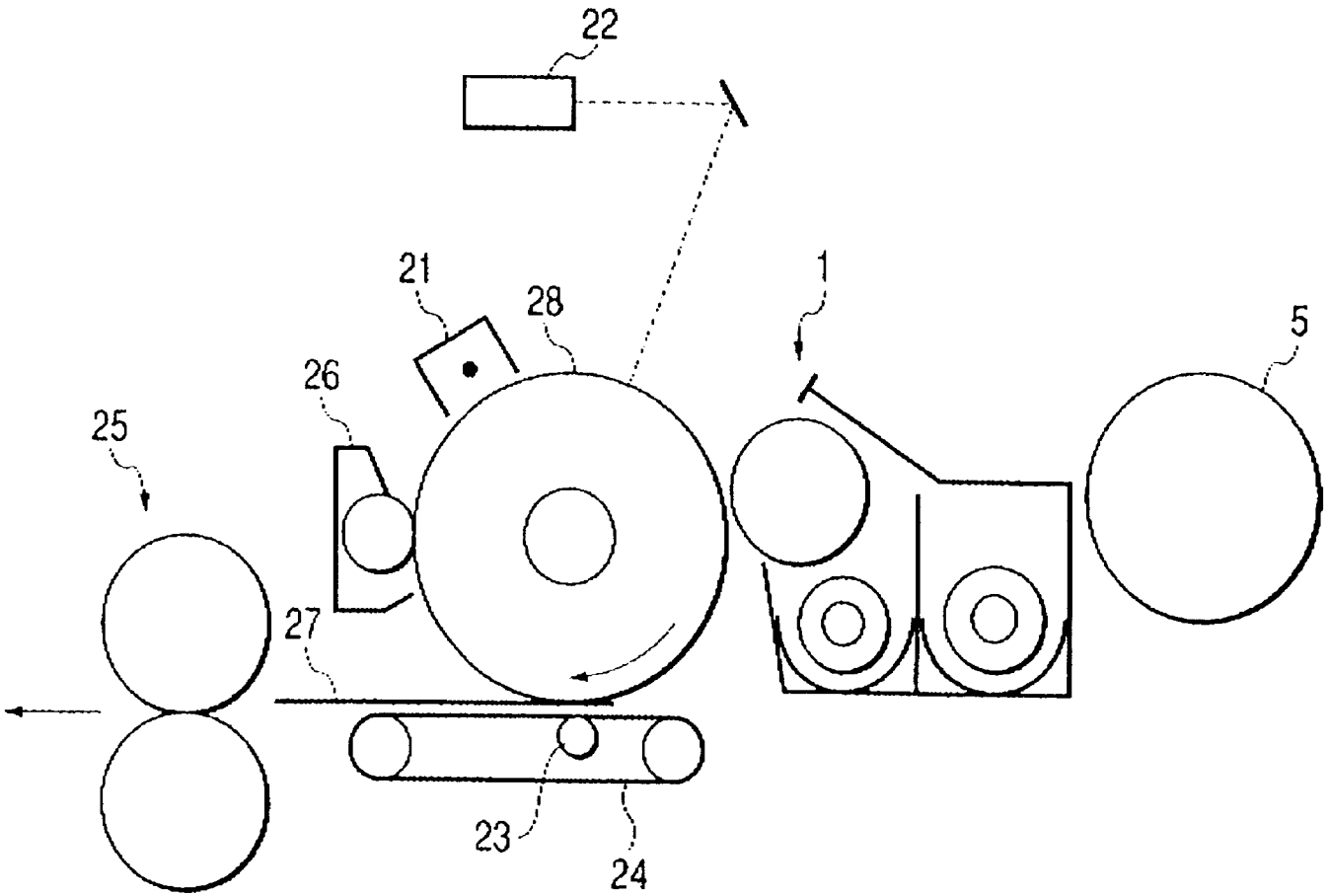
FIG. 7 is a typical cross-sectional view of an image forming apparatus according to a third embodiment of the present invention.

FIG. 7 shows a third embodiment. In the present embodiment, there is shown a case where the cleaning device is a magnetic brush cleaning device. In the other points, the construction and the method of eliminating the developer of the present embodiment are the same as those of the above-described embodiments and therefore, the same constituent portions are given the same reference characters and need not be described.

FIG. 7 is a typical cross-sectional view of the image forming apparatus according to the third embodiment of the present invention.

As shown in FIG. 7, the present embodiment is characterized in that the cleaning device is a magnetic brush cleaning device 26.

The magnetic brush cleaning device 26 causes the carrier to be magnetically bound directly on a magnet or on a sleeve containing the magnet therein to thereby form a magnetic brush portion, and the magnetic brush portion is stopped or rotated and brought into contact with the surface of the photosensitive drum 28 to thereby remove the waste toner on the surface of the drum.

Accordingly, the carrier adhering onto the surface of the drum is magnetically collected and therefore, there is little rubbing between the carrier and the surface of the drum and it can be made difficult for the surface of the drum to be injured by the collection of the carrier.

As described above, the magnetic brush cleaning device 26 is used as the cleaning device, whereby when the carrier is to be collected, the image area of the drum can be prevented from being injured and the quality of image can be prevented from being aggravated.

<Fourth Embodiment>

In this embodiment, description will be made of a case where the photosensitive drum is formed of amorphous silicon.

In the other points, the construction and the method of eliminating the developer of the present embodiment are the same as those of the above-described embodiments and therefore need not be described.

The photosensitive drum 28 is constructed with amorphus silicon hydride as a photosensitive layer. As is well known, an amorphous silicon drum has Vickers hardness of 1500 to 2000 kg/cm$^2$ and is very high in mechanical strength, and it is difficult for the surface of the drum to be injured by the collection of the carrier.

As described above, the photosensitive drum is made into the amorphous silicon drum, whereby when the carrier is to be collected, the image area of the drum can be prevented from being insured and the quality of image can be prevented from being aggravated. This also leads to the longer life of the entire image forming apparatus.

In each of the hitherto described embodiments, description has been made of a construction in which by the utilization of the fog removal voltage, as compared with the carrier not deteriorated, the deteriorated carrier is preferentially and selectively shifted from the developing sleeve to the photosensitive drum side. As described above, however, if an electrical force is given, only that part of the carrier which is deteriorated can be preferentially eliminated and therefore, instead of utilizing the fog removal voltage, for example, a deteriorated developer shifting member exclusively for shifting the deteriorated developer on the developing sleeve may be provided discretely.

However, it is preferable that the electrical force given at this time be set so as not to attract fresh carrier together with the deteriorated carrier. That is, if the electrical force is set to a magnitude which can attract only that part (deteriorated carrier) of the carrier contained in the developer container 2 which has been charged to a predetermined amount or greater, the deteriorated carrier can be eliminated preferentially (in probability).

What is claimed is:

1. A developer supplying apparatus comprising:

a developer container for containing developer including a toner and a carrier;

a developer bearing member for magnetically bearing and carrying the developer in said developer container to develop an electrostatic latent image formed on an image bearing member;

detecting means for detecting information corresponding to a density of the toner; and supplying means for supplying the toner and the carrier to said developer container in conformity with an output of said detecting means, wherein an intensity of an electric field for shifting the carrier from said developer bearing member to said image bearing member is greater than an intensity of an electric field formed between a non-image portion of the electrostatic latent image formed on said image bearing member and said developer bearing member.

2. A developer supplying apparatus according to claim 1, further comprising collecting means for collecting the carrier on said image bearing member shifted from said developer bearing member.

3. A developer supplying apparatus according to claim 2, wherein said collecting means collects the carrier by a magnetic force.

4. A developer supplying apparatus according to claim 2, wherein said collecting means is provided with a blade contacting with an image formable area and a non-image formable area on said image bearing member.

5. A developer supplying apparatus according to claim 4, wherein the carrier is shifted from said developer bearing member to said non-image formable area of said image bearing member.

6. A developer supplying apparatus according to claim 5, wherein said non-image formable area is provided on lengthwise end portions of said image bearing member.

7. A developer supplying apparatus according to claim 1, wherein said detecting means magnetically detects the information corresponding to the density of the toner in said developer container.

8. A developer supplying apparatus according to claim 5, wherein said detecting means optically detects the information corresponding to the density of the toner in said developer container.

9. A developer supplying apparatus according to claim 1, further comprising magnetic field generating means for generating a magnetic field for causing the developer to be borne on said developer bearing member.

10. A developer supplying apparatus according to any one of claims 1 to 9, wherein said supplying means is provided with a supplying container detachably mountable on a main body of the developer supplying apparatus and containing the toner and the carrier therein.

11. A developer supplying apparatus according to claim 10, wherein said supplying means supplies the toner and the carrier to said developer container from said supplying container mounted on the main body of the developer supplying apparatus.

* * * * *